US006568867B1

(12) United States Patent
Okamoto

(10) Patent No.: US 6,568,867 B1
(45) Date of Patent: May 27, 2003

(54) PEN-TYPE VESSEL FOR NAIL POLISH

(75) Inventor: Shigeru Okamoto, Tokyo (JP)

(73) Assignee: Salada Town Co., Ltd., Tokyo (JP)

( * ) Notice: Subject to any disclaimer, the term of this patent is extended or adjusted under 35 U.S.C. 154(b) by 0 days.

(21) Appl. No.: 09/694,260

(22) Filed: Oct. 24, 2000

(30) Foreign Application Priority Data

Mar. 31, 2000 (JP) ..... 2000-097641
Sep. 12, 2000 (JP) ..... 2000-006630

(51) Int. Cl.[7] ..... A46B 11/00
(52) U.S. Cl. ..... 401/129; 401/126
(58) Field of Search ..... 401/118, 126, 401/129

(56) References Cited

U.S. PATENT DOCUMENTS 4,433,928 A * 2/1984 Kingsford ..... 401/122
4,841,996 A * 6/1989 Gueret ..... 132/320
5,909,976 A * 6/1999 Maeda ..... 401/129

* cited by examiner

*Primary Examiner*—David J. Walczak
*Assistant Examiner*—Peter deVore
(74) *Attorney, Agent, or Firm*—Armstrong, Westerman & Hattori, LLP

(57) ABSTRACT

A pen-type vessel for nail polish comprising a slender vessel main body (1) formed by a specific resin of high impermeability to gases, a neck member (2) which is formed by a resin having an extremely inadhesive surface and joined to the vessel main body and a cap (7) provided with an applicator (9).

6 Claims, 3 Drawing Sheets

PEN-TYPE VESSEL FOR NAIL POLISH

BACKGROUND OF THE INVENTION

1. Field of the Invention

This invention relates to a vessel for nail polish and more particularly relates to a novel pen-type vessel for nail polish.

2. Prior Art

A main body of conventional vessels for nail polish is necessarily made of transparent glass, because color and remaining quantity thereof can be easily and directly checked with the naked eye through the vessels from outside, although color of the nail polish is printed on the label.

As a nail polish should be quick-dried after application, there is usually used a solvent of high volatility such as acetone and toluene to dissolve nitrocellulose as a main component. This is the reason why a material of high impermeability to gases is always used at least as a main body of vessels for nail polish.

Glass is the best material to satisfy the above mentioned requirement and is produced easily.

However, as glass is originally fragile and is rather dangerous if it breaks by chance, sufficient strength is required when glass is used as a nail polish vessel, which sometimes inconveniently restricts a shape thereof. On the other hand, as a nail polish is a kind of daily necessities, strengthening of glass vessels should be done from a standpoint of economy to keep the cost of strengthening within a reasonable range.

High adhesivity is required for a nail polish which generally contains nitrocellulose as a raw material. A vessel cap is often glued closely to the vessel due to the nail polish left around a vessel opening so that the cap is hardly taken off. The nail polish is then gradually accumulated and hardened around the opening, which makes it further difficult to take off or put on the cap smoothly.

The above mentioned negative feature of a conventional vessel for nail polish restricts a shape thereof and substantially affects its handiness.

SUMMARY OF THE INVENTION

It is an object of the present invention to provide a pen-type vessel for nail polish comprising a slender vessel main body formed by a specific functional resin of high impermeability to gases in which one end portion thereof is opened and a resin cap which is provided with an applicator and is detachable from the vessel main body.

Another object of the present invention is to provide a pen-type vessel for nail polish comprising a slender vessel main body formed by a specific functional resin of high impermeability to gases in which one end portion thereof is opened, a resin neck member of high lubricating properties which is joined to the open end portion of the main body in a sealed condition and a resin cap which is provided with an applicator and is detachable from the vessel main body.

DETAILED DESCRIPTION AND THE PREFERRED EMBODIMENTS

Figure 1:
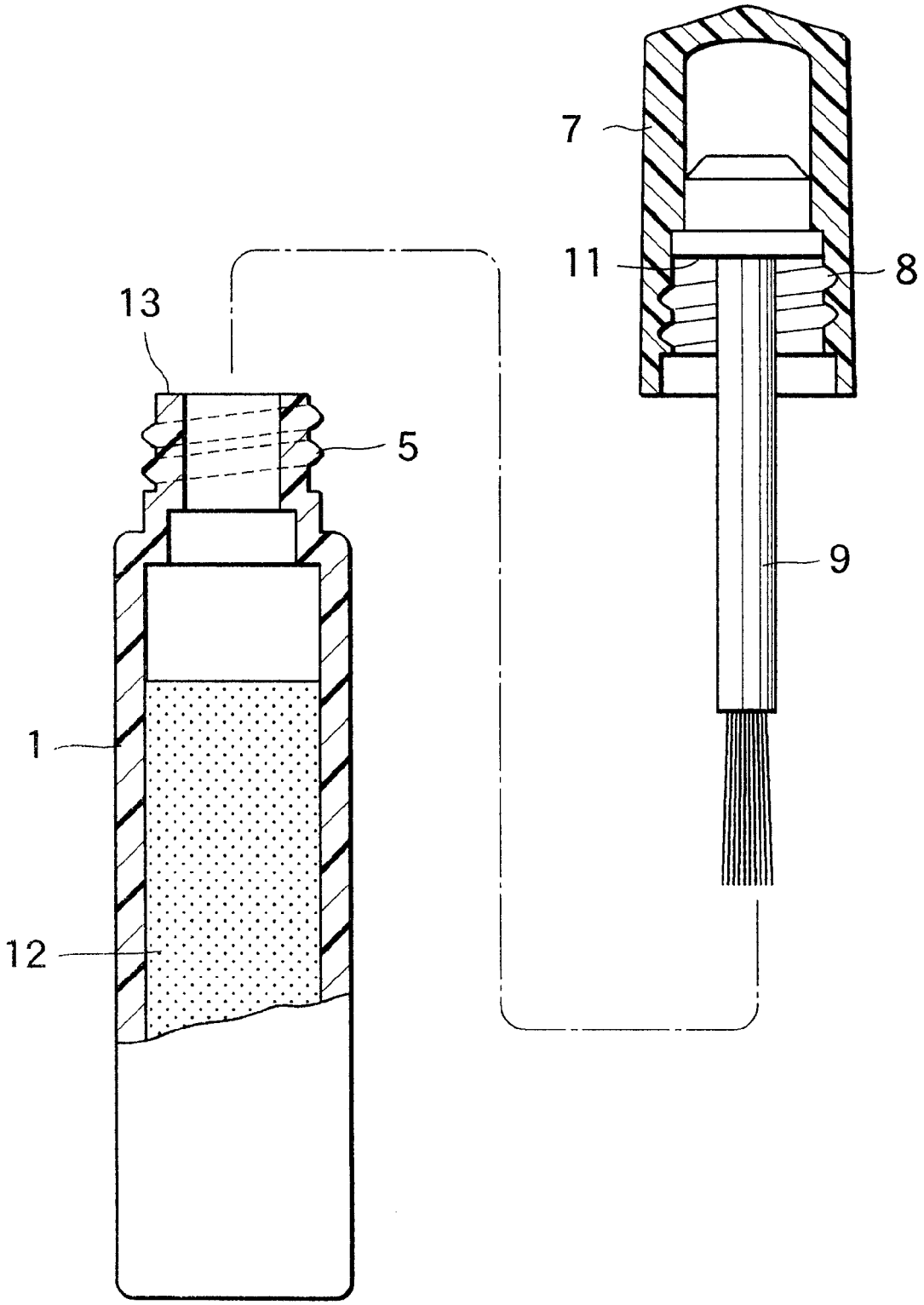
FIG. 1 is a central cross-sectional illustration of a vessel for nail polish of the present invention when a cap is removed therefrom.

As a material for a vessel for nail polish of the present invention, there may be used a resin of high impermeability to gases, reasonably high clarity and suitable hardness such as ethylene-vinyl alcohol copolymer (EVOH), polyvinylidene chloride (PVDC) and polyacrylonitrile (PAN).

As a material for a cap of the present vessel, there may be used any conventional resin and preferably a resin having an extremely inadhesive surface such as polypropylene and silicone resins.

As a material for a neck member which is specially joined to an open end portion of the present vessel, there may be used a resin having an extremely inadhesive surface and suitable hardness such as polypropylene and silicone resins. The above mentioned material does not cause adhesion of a nail polish after it dries, which is easily pealed off as a solidified layer.

An applicator fixed inside of the cap may be made and shaped by using a conventional material.

The cap may be detachably put on a main body or open end portion of the present vessel in a sealed condition in any conventional manner such as screwing.

The pen-type vessel for nail polish of the present invention comprises a main vessel body formed by a material of considerably high impermeability to gases and a cap and/or neck member formed by the other material having an extremely inadhesive surface or anti-adhesivity.

Such a combination of different materials makes it possible to prevent unexpected accident during nail polishing caused by breakage of the vessel while keeping impermeability thereof.

Further, the cap is hardly glued to the vessel main body by the dried and solidified nail polish, which allows smooth fixture or removal of the cap.

The slender pen-type vessel of the present invention is also quite handy and suitable for outdoor use.

According to the vessel of the present invention, color and remaining quantity of the nail polish in the vessel can be easily checked with the naked eye similarly as conventional glass vessels, while no volatile gas is leaked out the vessel nor the nail polish is solidified.

EMBODIMENTS

Referring now to the drawings, the present invention will be further described in the following embodiments.

Embodiment 1.

FIG. 1 is a central cross-sectional illustration of a vessel for nail polish according to one embodiment when a cap is removed therefrom. Numeral 1 designates a slender cylindrical pen-type vessel main body which upper portion is opened. The vessel is formed as a whole by a specific functional resin of considerably high impermeability to gases. This functional material is an acrylonitrile thermoplastic resin having extremely high impermeability to gases, chemical resistance, clarity, odor resistance, etc. and is available from Mitsui Chemical Co., Ltd. as a trade name of BAREX.

An external thread 5 is formed on the outer surface of an open end portion of the vessel main body 1, an inner diameter thereof being small.

Numeral 7 designates a cap made of a polypropylene resin. An external thread 8 is formed on the inner surface of the open end portion of the cap 7, which corresponds to the outer thread 5 of the vessel main body 1.

The inner thread 8 is put into the external thread 5 to fix the cap 7 to the vessel main body 1.

An applicator 9 with a brush head portion is fixed inside of the cap 7. The applicator 9 may be fixed to the cap 7 in a conventional manner.

When the cap 7 is put on the vessel main body 1 completely, a top end portion 13 of the vessel 1 firmly contacts with a base portion 11 of the applicator 9.

Numeral 12 designates a nail polish.

Embodiment 2.

Figure 2:
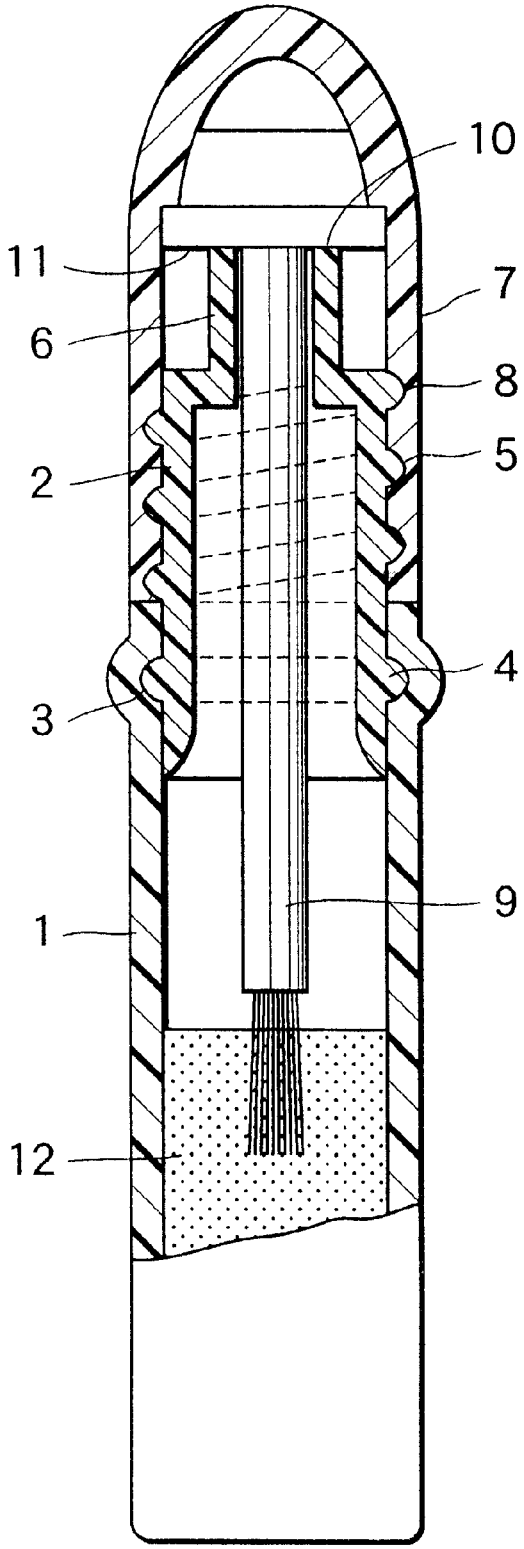
FIG. 2 is a central cross-sectional view of a vessel for nail polish of the present invention.
Figure 3:
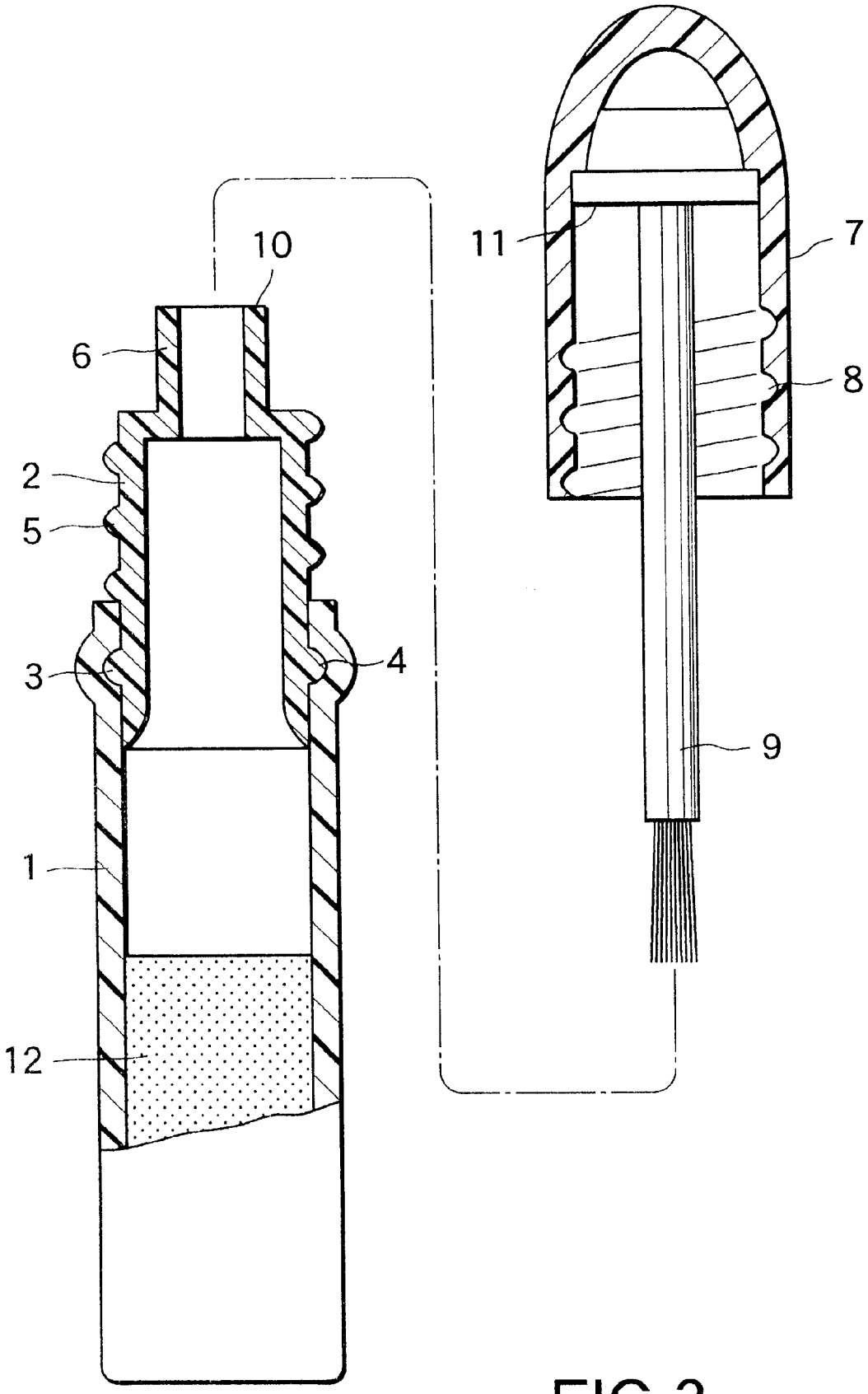
FIG. 3 is a central cross-sectional illustration of a vessel for nail polish according to another embodiment of the present invention when a cap is removed therefrom.

FIG. 2 is a central cross-sectional view of a vessel for nail polish according to another embodiment and FIG. 3 is a central cross-sectional illustration of a vessel for nail polish shown in FIG. 1 when a cap is removed therefrom.

Numeral 1 designates a slender cylindrical pen-type vessel main body which upper portion is opened. The vessel is formed as a whole by a specific functional resin of considerably high impermeability to gases. This functional material is an acrylonitrile thermoplastic resin having extremely high impermeability to gases, chemical resistance, clarity, odor resistance, etc. and is available from Mitsui Chemical Co., Ltd. as a trade name of BAREX.

A neck member 2 is in a shape of double structure made of a polypropylene resin which upper and bottom portions are opened and is joined to an open end portion of the vessel main body 1 as a seal. A ring-like concave flute 3 is formed inside of the vessel main body 1 by expanding the open end portion of the vessel 1 outside in the circumferential direction, while a ring-like convex flute 4 is formed around the thicker bottom end portion of the double structured neck member 2 to fix thereof in the concave flute 3. The neck member is thus joined to the vessel main body 1 by means of concave flute 3 and the corresponding convex flute 4.

Inner structure of the vessel main body 1 where the neck member is joined and corresponding outer structure of the neck member 2 meet each other firmly, which allows to join these two parts in a completely sealed condition.

Numeral 7 designates a cap. Internal threads 8 which correspond to external threads 8 are formed inside of an open end of the cap 7.

External threads 5 are formed on an outer wall of thicker portion of the double structured neck member 2 where is not contacted with the vessel main body 1. The external threads 5 are put on internal threads to fix a cap 7 to the vessel main body 1.

A slender and top-opened end portion 6 of the double structured neck member 2 has a diameter slightly wider than that of an applicator 9 fixed to the cap 7, thereby an open space thereof being reduced.

The neck member 2 is not necessarily double structured. In such a case, the vessel main body is preferably double structure in which a joint portion thereof to the neck member 2 is thin, so as to reduce the outside open space of the neck member 2 as possible.

The applicator 9 with a brush head portion is fixed inside of the cap 7. The applicator 9 may be fixed to the cap 7 in a conventional manner.

When the cap 7 is put on the vessel main body 1 completely, a top end portion 13 of the vessel 1 firmly contacts with a base portion 11 of the applicator 9.

Numeral 12 designates a nail polish.

What is claimed is:

1. A pen-type vessel for nail polish comprising a slender vessel main body formed by a specific functional resin of high impermeability to gases in which one end portion thereof is opened and a cap, made of a resin having an extremely inadhesive surface, which is provided with an applicator and is detachable from the vessel main body, wherein said specific functional resin of high impermeability to gases is either ethylene-vinyl alcohol copolymer (EVOH) or polyvinylidene chloride (PVDC).

2. A pen-type vessel for nail polish comprising a slender vessel main body formed of a specific functional resin of high impermeability to gases in which one end portion thereof is opened, a separate neck member formed of a specific resin of high lubricating properties which is joined to the open end portion of the main body in a sealed condition, and a cap, formed of a specific resin having an extremely inadhesive surface, which is provided with an applicator and is detachable from the neck member.

3. A pen-type vessel for nail polish claimed in claim 2 wherein the specific resin having an extremely inadhesive surface is polypropylene or silicone resin.

4. A pen-type vessel for nail polish comprising a slender vessel main body formed by a specific functional resin of high impermeability to gases in which one end portion thereof is opened and a cap, made of a resin having an extremely inadhesive surface, which is provided with an applicator and is detachable from the vessel main body, wherein the specific functional resin is polyacrylonitrile.

5. A pen-type vessel for nail polish comprising a slender vessel main body formed by a specific functional resin of high impermeability to gases in which one end portion thereof is opened, a resin neck member of high lubricating properties which is joined to the open end portion of the main body in a sealed condition and a cap, made of a resin having an extremely inadhesive surface, which is provided with an applicator and is detachable from the vessel main body, wherein the specific functional resin is polyacrylonitrile.

6. A pen-type vessel for nail polish comprising a slender vessel main body formed by a specific functional resin of high impermeability to gases in which one end portion thereof is opened and a cap, made of a resin having an extremely inadhesive surface, which is provided with an applicator and is detachable from the vessel main body, wherein said specific functional resin of high impermeability to gases is either ethylene-vinyl alcohol copolymer (EVOH) or polyvinylidene chloride (PVDC), and the resin having an extremely inadhesive surface is polypropylene or silicone resin.

* * * * *